US011568770B2

(12) United States Patent
Gardner

(10) Patent No.: US 11,568,770 B2
(45) Date of Patent: Jan. 31, 2023

(54) ILLUMINATED SIGNAGE

(71) Applicant: Omari Gardner, Cincinnati, OH (US)

(72) Inventor: Omari Gardner, Cincinnati, OH (US)

( * ) Notice: Subject to any disclaimer, the term of this patent is extended or adjusted under 35 U.S.C. 154(b) by 0 days.

(21) Appl. No.: 17/443,157

(22) Filed: Jul. 21, 2021

(65) Prior Publication Data

US 2022/0028305 A1 Jan. 27, 2022

Related U.S. Application Data

(60) Provisional application No. 63/054,386, filed on Jul. 21, 2020.

(51) Int. Cl.

| | |
|---|---|
| ***G09F 13/04*** | (2006.01) |
| ***G09F 27/00*** | (2006.01) |
| ***G09F 13/00*** | (2006.01) |
| *G09F 13/22* | (2006.01) |

(52) U.S. Cl.

CPC ..... *G09F 13/0413* (2013.01); *G09F 13/005* (2013.01); *G09F 27/007* (2013.01); *G09F 27/005* (2013.01); *G09F 2013/222* (2013.01)

(58) Field of Classification Search

CPC .. G09F 13/0413; G09F 13/005; G09F 27/007; G09F 27/005; G09F 2013/222

See application file for complete search history.

(56) References Cited

U.S. PATENT DOCUMENTS

| | | | | |
|---|---|---|---|---|
| 2,893,148 | A * | 7/1959 | Figman | G09F 13/06 362/255 |
| 4,466,208 | A | 8/1984 | Logan, Jr. et al. | |
| 4,532,579 | A | 7/1985 | Merryman | |
| 4,765,080 | A * | 8/1988 | Conti | G09F 13/04 40/576 |
| 5,388,357 | A | 2/1995 | Malita | |
| 5,890,306 | A * | 4/1999 | Smith | G09F 13/04 40/576 |
| 6,964,366 | B2 | 11/2005 | Peng et al. | |
| 6,994,448 | B1 | 2/2006 | Gorrell | |
| 7,036,255 | B1 | 5/2006 | Santana et al. | |
| 7,263,792 | B2 | 9/2007 | Slowski | |
| 7,810,262 | B2 | 10/2010 | Sadon | |
| 8,819,968 | B1 * | 9/2014 | Van Beek | G09F 27/007 40/605 |
| 9,465,364 | B2 | 10/2016 | Willemin et al. | |
| 9,657,909 | B2 | 5/2017 | Cohen | |
| 9,960,311 | B1 | 5/2018 | Benezra | |
| 10,755,609 | B1 | 8/2020 | Harris | |
| 2003/0009924 | A1 | 1/2003 | Sajadian | |
| 2004/0062032 | A1 | 4/2004 | Mass | |
| 2005/0193605 | A1 | 9/2005 | Ahmadi | |
| 2006/0123679 | A1 | 6/2006 | Scruggs | |

(Continued)

*Primary Examiner* — Gary C Hoge

(74) *Attorney, Agent, or Firm* — Squire Parent Consulting & IP Law LLC; Brendan E. Squire

(57) ABSTRACT

An illuminated signage has a housing that carries a plurality of signage panels having a photoluminescent area carrying indicia for the signage. The signage panels are carried in a channel extending across a front face of the housing. An electrical circuit controls a plurality of light emitters that are configured to illuminate when the photoluminescent area has been depleted and is no longer producing enough luminescence to illuminate the indicia. The electrical circuit may also be configured to illuminate the LEDs on demand.

10 Claims, 4 Drawing Sheets

(56) References Cited

U.S. PATENT DOCUMENTS

| | | | | |
|---|---|---|---|---|
| 2006/0213099 | A1* | 9/2006 | Vazquez | G09F 13/06 40/574 |
| 2006/0274521 | A1 | 12/2006 | Ullrich | |
| 2008/0155870 | A1* | 7/2008 | Taylor | G09F 13/04 40/564 |
| 2008/0155871 | A1* | 7/2008 | Parker | G09F 13/06 40/576 |
| 2010/0011638 | A1* | 1/2010 | Choi | G09F 13/18 40/446 |
| 2012/0310821 | A1 | 12/2012 | Abramowitz et al. | |
| 2014/0298696 | A1 | 10/2014 | Hunter | |
| 2015/0302782 | A1 | 10/2015 | Senonal et al. | |
| 2017/0243527 | A1* | 8/2017 | Flieder | G09F 13/06 |
| 2019/0012940 | A1* | 1/2019 | Hinton | G09F 15/0012 |
| 2021/0117915 | A1* | 4/2021 | Newcomb | G09F 27/004 |

* cited by examiner

ILLUMINATED SIGNAGE

CROSS-REFERENCE TO RELATED APPLICATION

This application claims the benefit of priority of U.S. provisional application No. 63/054,386, filed Jul. 21, 2020, the contents of which are herein incorporated by reference.

BACKGROUND OF THE INVENTION

The present invention relates to illumination devices, and more particularly to illumination devices for address signage.

Current address signage, particularly those in residential areas, suffer from a lack of visibility at night after the sun has gone down.

The current devices on the market use LED only which have to be powered, Others utilize a solar power source which require more maintenance overtime, particularly when the battery of the solar powered is no longer able to retain a charge.

As can be seen, there is a need for an improved illumination device for address signage.

SUMMARY OF THE INVENTION

In one aspect of the present invention, a signage illumination device is disclosed. The signage illumination device includes a housing having a front surface, a back surface, a top surface, and an interior cavity defined therein. A channel is defined along the front surface of the housing. A plurality of signage panels are dimensioned to be carried in the channel. One or more of the plurality of signage panels have a photoluminescent area carrying indicia thereon and an opaque area surrounding the indicia. An electrical circuit is carried within the interior cavity and is configured to selectively illuminate a light source contained within the housing.

In some embodiments, a battery is included to power the electrical circuit.

In some embodiments, a solar panel is carried on the top surface of the housing. The solar panel is operatively connected to the electrical circuit to selectively charge the battery.

In some embodiments, the electrical circuit is configured to detect a low illumination condition of the photoluminescent area and activate the light source to replenish the photoluminescent area. In some embodiments, a photo sensor is contained within the housing to detect the low illumination condition. In some embodiments, the low illumination condition is user selectable.

In some embodiments, the electrical circuit includes a micro controller that configured to control one or more of a charge state of a battery or an illumination of the light source. The micro controller may be configured to selectively activate the light source for a predetermined temporal period to replenish the photoluminescent areal.

In some embodiments, a communications module is configured to receive a control signal to selectively activate the light source.

In other embodiments, a wireless transmitter is in communication with the communications module. The wireless transmitter is configured selectively initiate the control signal.

In yet other embodiments, the wireless transmitter is a mobile computing device having an application software configured to selectively initiate the control signal.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
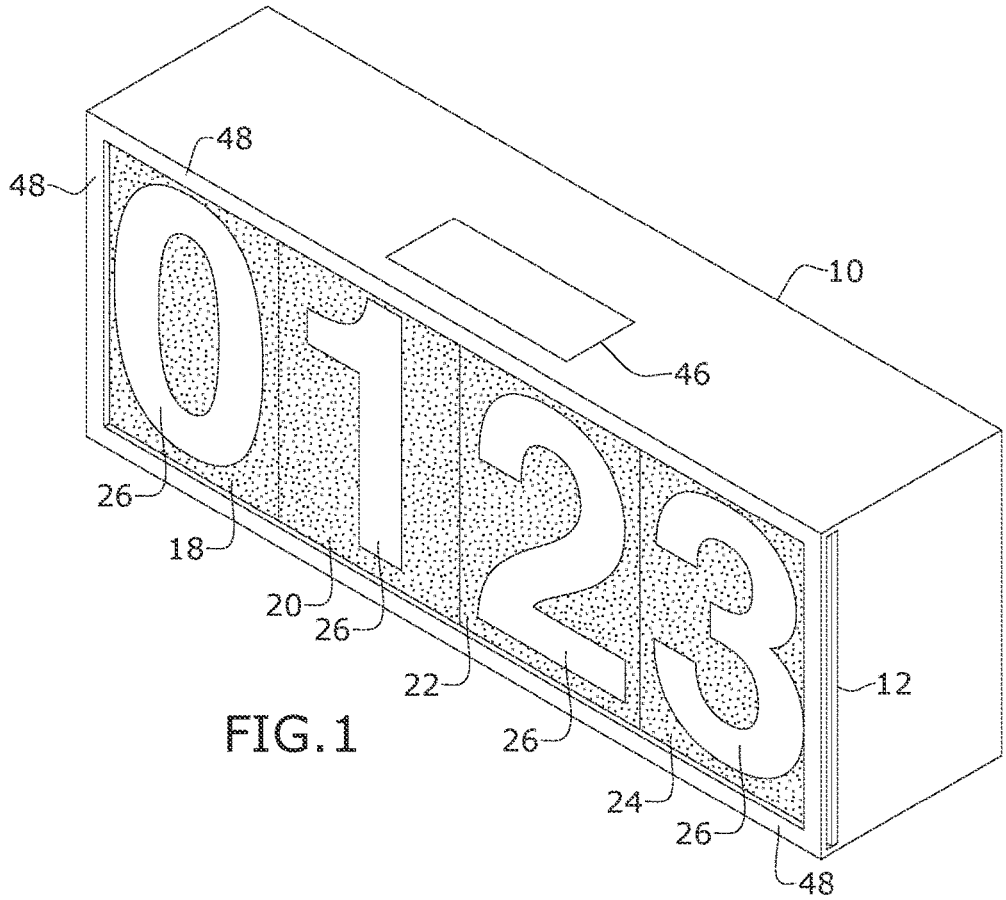
FIG. 1 is a perspective view of the illuminated signage.
Figure 2:
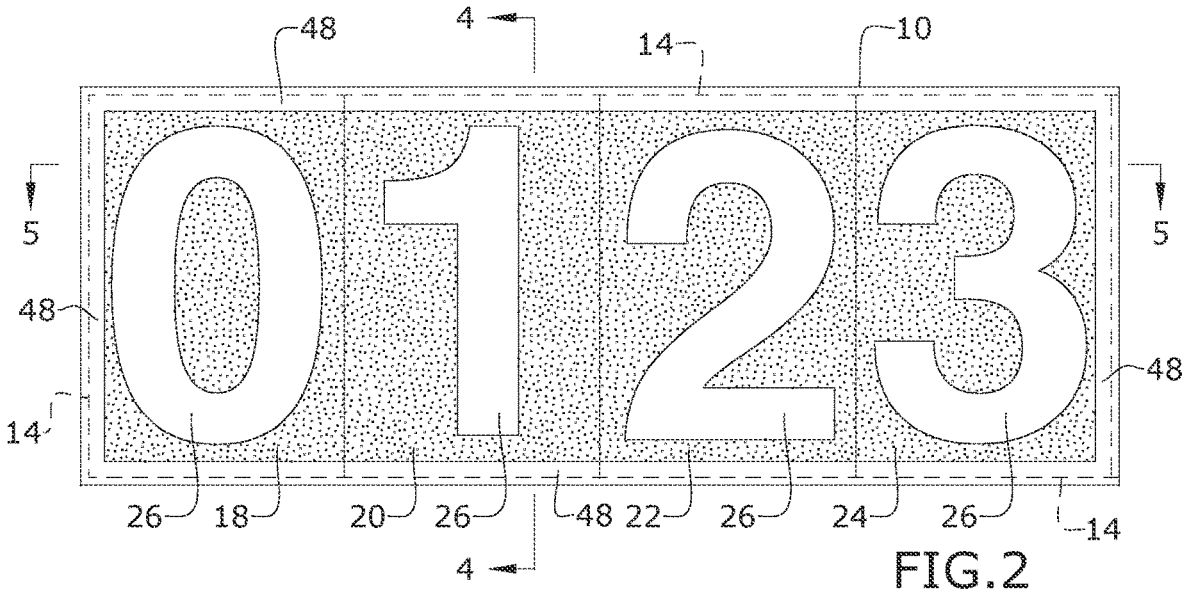
FIG. 2 is a front elevation view of the illuminated signage.
Figure 3:
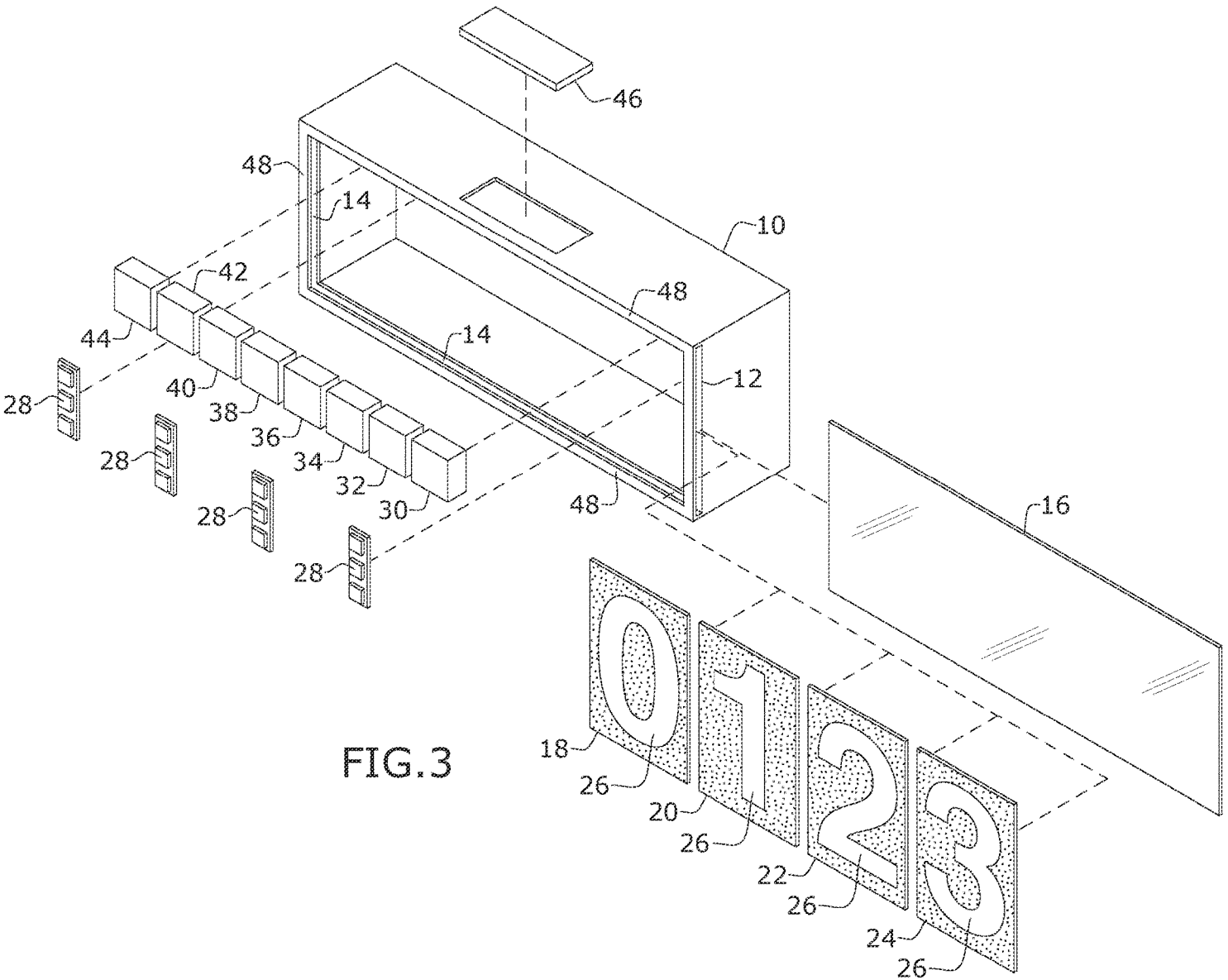
FIG. 3 is an exploded view of the illuminated signage.
Figure 4:
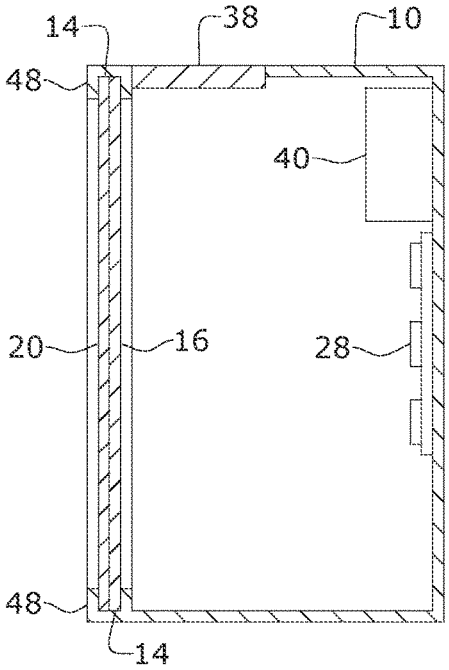
FIG. 4 is a section view taken along line 4-4 from FIG. 2.
Figure 5:
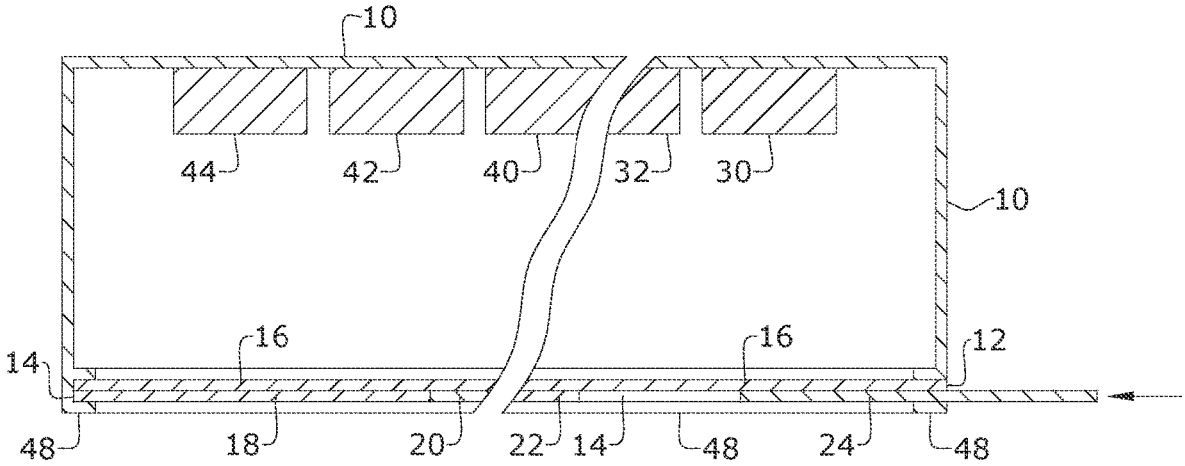
FIG. 5 is a section view taken along line 5-5 from FIG. 2.
Figure 6:
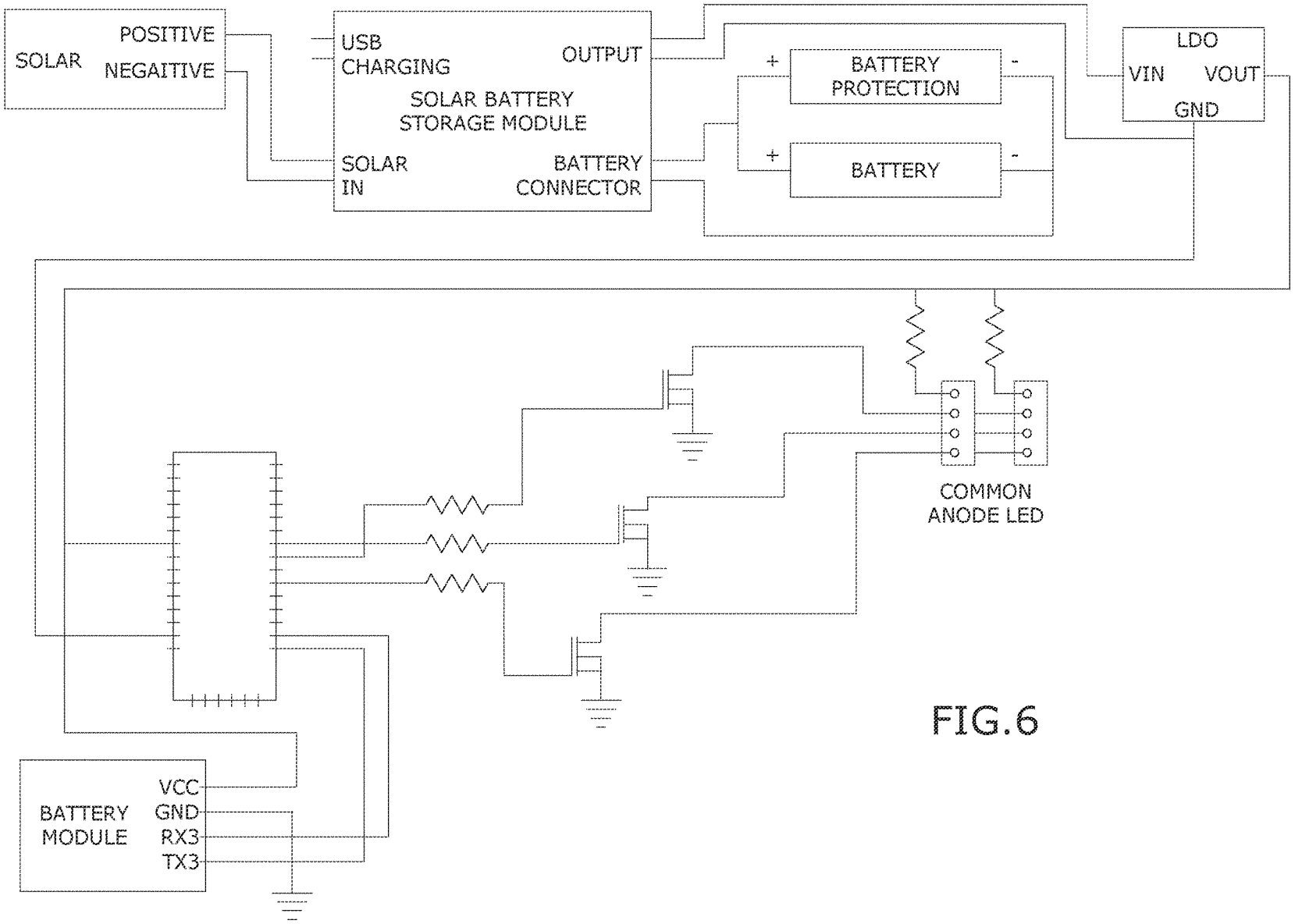
FIG. 6 is a wiring schematic of the illuminated signage.

Broadly, embodiments of the present invention provide an apparatus and method for illuminating signage. In the non-limiting embodiment show in the drawings of FIGS. 1-6, the illuminated signage includes a housing 10 for retaining the components of the illuminated signage. The housing 10 has an insert opening 12 to a channel 14 extending across a front face of the housing 10. A plurality of signage panels 18-24 are dimensioned to be received through the opening 12 and are carried in the channel 14 across the front face of the housing 10. A frame 48 or bezel may be provided for a decorative finish and to prevent light from being emitted around the front face of the housing 10.

In the embodiment shown, the plurality of signage panels 18-24 may carry one or more alpha-numeric characters in an indicia area, designating an address. As will be appreciated, the plurality of signage panels 18-24 may also be embellished with other characters, icons, or symbols. The plurality of signage panels 18-24 may also include a blank, or no character, to provide a spacing between a preceding panel and a subsequent signage panel. The plurality of signage panels 18-24 carrying the indicia will be provided in a photoluminescent area 26 of the signage panel 18-24. The photoluminescent area 26 provides an illumination of the indicia. The photoluminescent area 26 and the indicia may be surrounded by an opaque or primarily opaque area to provide an illuminated indication of the indicia carried on the panel.

The housing 10 may also contain a plurality of light emitting diode (LED) lights 28 or other low power illumination source powered by an electrical circuit. The electrical circuit is configured to illuminate the LED lights 28 when the photoluminescent area 26 has been depleted and is no longer producing enough luminescence to illuminate the indicia. The electrical circuit may also be configured to illuminate the LEDs on demand, such as when a homeowner is expecting a guest or a delivery.

The electrical circuit may include a micro-controller 30, a charging circuit 34, a voltage output module 36, a battery protection circuit 38, a battery 40, a converter 42, a photo sensor 44, and a solar panel 46. In some embodiments, the electrical circuit may also include communications module 32, such as a Bluetooth, Wi-Fi, or other wireless communications protocol, that is configured to communicate with a wireless transmitter, such as a remote, for command directed illumination of the LED lights 28. The wireless transmitter may include a mobile computing device, and an app configured to transmit a command to the communications module 32, to selectively activate or deactivate the LED lights 28.

The solar panel 46 is disposed on a top surface of the housing 10 to provide an electrical charge to charging circuit 34 for replenishment of the battery 40. The photo sensor 44 is configured to detect a user configurable illumination level of the photoluminescent area. When the photo sensor 44 detects an illumination level below a minimum setting, the electrical circuit activates the LED lights 28 to provide an illumination of the signage and to replenish the photoluminescent material in the photoluminescent area 26. The electrical circuit may then activate the LED lights 28 for a predetermined temporal period sufficient to replenish the photoluminescent material, after which time the LED lights 28 will be extinguished. Activation in this manner extends the life of the battery 40 to provide illumination of the signage and also extends the lifespan of the battery 40 by reducing the number of charging cycles the battery 40 is subjected to. If needed, due to insufficient solar energy such as when a dwelling frontage remains shaded for an extended duration, the electrical circuit may be connected to an external power source to replenish the battery 40 or to operate the electrical circuit.

The LED light 28, the photoluminescent area 26, and opaque area in the plurality of signage panels 18-24 work in tandem to illuminate—or create a visual contrast with—the house numbers so that they are more visible. The glow in the dark material is meant to provide more extended functionality to the visualization of the house number in darkness or night time.

It should be understood, of course, that the foregoing relates to exemplary embodiments of the invention and that modifications may be made without departing from the spirit and scope of the invention as set forth in the following claims.

What is claimed is:

1. A signage illumination device, comprising:

a housing having a front surface, a back surface, a top surface, and an interior cavity defined therein;

a channel defined along the front surface of the housing;

a plurality of signage panels dimensioned to be carried in the channel, wherein one or more of the plurality of signage panels have a photoluminescent area carrying indicia thereon and an opaque area surrounding the indicia; and an electrical circuit carried within the interior cavity, the electrical circuit configured to selectively illuminate a light source contained within the housing, detect a low illumination condition of the photoluminescent area, and activate the light source to replenish the photoluminescent area.

2. The signage illumination device of claim 1, further comprising:

a battery to power the electrical circuit.

3. The signage illumination device of claim 2, further comprising:

a solar panel carried on the top surface of the housing, the solar panel operatively connected to the electrical circuit to selectively charge the battery.

4. The signage illumination device of claim 1, further comprising:

a photo sensor contained within the housing to detect the low illumination condition.

5. The signage illumination device of claim 4, wherein the low illumination condition is user selectable.

6. The signage illumination device of claim 5, the electrical circuit further comprising:

a micro controller configured to control one or more of a charge state of a battery or an illumination of the light source.

7. The signage illumination device of claim 6, wherein the micro controller selectively activates the light source for a predetermined temporal period to replenish the photoluminescent areal.

8. The signage illumination device of claim 7, the electrical circuit further comprising:

a communications module configured to receive a control signal to selectively activate the light source.

9. The signage illumination device of claim 8, further comprising:

a wireless transmitter in communication with the communications module, the transmitter configured selectively initiate the control signal.

10. The signage illumination device of claim 9, wherein the wireless transmitter is a mobile computing device having an application software configured to selectively initiate the control signal.

* * * * *